US005182892A

United States Patent [19]

Chase

[11] Patent Number: 5,182,892

[45] Date of Patent: Feb. 2, 1993

[54] TONGUE AND GROOVE BOARD PRODUCT

[75] Inventor: Peter D. Chase, Houlton, Me.

[73] Assignee: Louisiana-Pacific Corporation, Hayden Lake, Id.

[21] Appl. No.: 746,228

[22] Filed: Aug. 15, 1991

[51] Int. Cl.[5] ..... E04F 15/02

[52] U.S. Cl. ..... 52/539; 52/533; 52/553

[58] Field of Search ..... 52/593, 578, 590, 589, 52/595, 533, 536, 539, 169.5, 302, 303; 403/340, 381

[56] References Cited

U.S. PATENT DOCUMENTS

| | | | |
|---|---|---|---|
| 432,245 | 7/1890 | Meigs . | |
| 576,569 | 2/1897 | Gemmer . | |
| 841,490 | 1/1907 | Du Montier . | |
| 1,163,613 | 12/1915 | Booraem | 52/539 |
| 2,031,596 | 2/1936 | Fulbright . | |
| 2,227,878 | 4/1938 | Crooks . | |
| 2,430,200 | 11/1947 | Wilson | 52/539 |
| 3,552,079 | 1/1971 | Mortensen | 52/233 |
| 3,619,961 | 11/1971 | Sterrett | 52/302 |
| 3,740,909 | 6/1973 | Stinnes | 52/302 |
| 3,818,653 | 6/1974 | Williams | 52/79 |
| 4,095,913 | 6/1978 | Pettersson | 403/364 |
| 4,807,416 | 2/1989 | Parasin | 52/595 |

*Primary Examiner*—David A. Scherbel
*Assistant Examiner*—Matthew E. Leno
*Attorney, Agent, or Firm*—Marger, Johnson, McCollom & Stolowitz, Inc.

[57] ABSTRACT

The invention is directed to a tongue and groove product which comprises a first and second major surface and a first and second longitudinal edge. The first longitudinally edge including means defines a longitudinally-extending groove. The second longitudinal edge includes a longitudinally-extending protruding tongue for interlockingly engaging a complimentary grooved longitudinal edge of an adjacent tongue and groove board. The protruding tongue has an upper and a lower longitudinally-extending surface. The major design feature of this invention is that the protruding tongue has at least one substantially vertically-extending opening formed therein. Each of the openings extends through the protruding tongue from said longitudinally-extending upper surface to said longitudinally-extending lower surface for providing at least one drain path for water to drain by gravity from said first major surface downwardly through each said vertically-extending opening. This prevents an accumulation of water on the tongue and groove board. In the preferred case, the opening in the protruding tongue comprises a substantial vertically-extending notch.

29 Claims, 7 Drawing Sheets

TONGUE AND GROOVE BOARD PRODUCT

BACKGROUND OF THE INVENTION

1. Field of the Invention

The present invention relates to structural boards used for floors, and in particular, an improved tongue and groove board which can be assembled to form a floor surface.

2. Description of Related Art

Tongue and groove (T&G) structural boards are well known in the construction industry. They are typically made from plywood, particleboard, waferboard, strand board, or other composite wood product materials. Tongue and groove boards are particularly well suited for installation on a joist framing assembly to form a structural sub-floor. T&G boards serve especially well as sub-flooring because of their interlocking edges which reduce vertical offset between adjacent boards resulting in a smoother floor. In addition, the interconnected edges prevent relative movement between adjacent edges as persons walk on the floor, thereby reducing squeaking in the floor. Typically, carpet, tile or a hardwood is installed over the structural sub-floor to provide the finished floor surface.

U.S. Pat. No. 4,807,416 to Parasin and U.S. Pat. No. 4,095,913 to Pettersson et al disclose tongue and groove boards incorporating particular tongue and groove shapes and features designed to reduce stresses generated by water absorption along the interconnected edges of adjacent T&G boards, and thereby reduce buckling. However, no provision is made for a means to reduce or prevent the accumulation of water on the upper surface of the sub-floor.

U.S. Pat. No. 2,031,596 to Fulbright discloses tongue and groove boards held together by an embedded spring to form a floor block assembly. U.S. Pat. No. 432,245 to Meigs discloses a lumber strip for installation over a sub-floor to form a finished floor surface which incorporates vertical channels spaced along the tongued edge of the strip. The channels are cut into the upper surface of the strip to accommodate blind nailing of the strip to the sub-floor.

U.S. Pat. No. 576,569 to Gemmer and No. 3,740,909 to Stinnes disclose wall boards incorporating interlocking grooves to provide a weathertight seal between adjacent boards.

While T&G boards are generally very useful in this application, they are subject to damage if water accumulates on the sub-floor surface during the construction of the building. Water often accumulates in small pools on the assembled sub-floor when rain or snow falls before the building is completed. The result is that the boards may buckle along their edges as the boards and the interlocking edges swell from water absorption. A solution for this problem is not disclosed on the prior art.

A need therefore exists for a T&G board for use in assembling a sub-floor assembly which reduces or prevents the accumulation of water on the upper surface of the sub-floor, and which is economical to produce without major modification to existing production facilities.

SUMMARY OF THE INVENTION

The subject invention meets the above-described existing needs by providing a tongue and groove board for use in assembling a sub-floor assembly which reduces or prevents the accumulation of water on the upper surface of the sub-floor, and which is economical to produce without major modification to existing production facilities.

The T&G board of the present invention comprises a first and second major surface and a first and second longitudinal edge. The first longitudinally edge including means defines a longitudinally-extending groove. The second longitudinal edge includes a longitudinally-extending protruding tongue for interlockingly engaging a complimentary grooved longitudinal edge of an adjacent tongue and groove board. The protruding tongue has an upper and a lower longitudinally-extending surface.

The major design feature of this invention it that the protruding tongue has at least one substantially vertically-extending opening formed therein. Each of the openings extends through the protruding tongue from said longitudinally-extending upper surface to said longitudinally-extending lower surface for providing at least one drain path for water to drain by gravity from said first major surface downwardly through each said vertically-extending opening. This prevents an accumulation of water on the tongue and groove board. In the preferred case, the opening in the protruding tongue comprises a substantial vertically-extending notch. The material from which the T&G board is manufactured comprises any one of wood and a composite wood product. The composite wood product can comprise any one of plywood, particleboard, waferboard and strand board. A self-draining floor assembly can be comprised of a plurality of interconnected tongue and groove boards as described above.

A method is provided for making the tongue and groove board of this invention. First, a tongue and groove board is provided having a first and second major surface, a first longitudinal edge including means defining a longitudinally-extending groove, and a second longitudinal edge including means defining a longitudinally-extending protruding longitudinal tongue. At least one substantially vertically-extending opening is then introduced into the tongue for providing a drain path for water to drain by gravity from said first major surface downwardly through each said vertically-extending opening. A method of forming a self-draining floor assembly of tongue and groove boards is also provided. The subject tongues of T&G boards are interlockingly engaged by inserting the protruding tongue of a first tongue and groove board into said longitudinal groove of a second tongue and groove board. In this way a selfdraining floor assembly is formed because of the presence of the drain path in the floor assembly.

In one form of this invention, the longitudinally-extending protruding tongue has an outer configuration which is different than the outer configuration of said longitudinally-extending groove. This forms a drain path between said longitudinally-extending protruding tongue and said longitudinally-extending groove. In another form of this invention. the lateral dimension of outer end of the longitudinally-extending protruding tongue is greater than the depth of the recess formed by said longitudinally-extending groove, thereby forming a drain path between said longitudinally-extending protruding tongue and said longitudinally-extending groove. Finally, in a further form of this invention, the longitudinally-extending groove is tapered so that the height of the groove is less at its inner edge than at its outer edge. Then, the vertical dimension of the outer end of the longitudinally-extending protruding tongue is greater than the vertical height of the recess formed by the longitudinally-extending groove at its inner edge, so that when the tongue is inserted into the complementary groove of an adjacent tongue and groove board, the outer tongue edge engages the tapered groove in an interference fit. Thus, the spacing of the outer tongue end is away from the recess inner edge so that a drain path is formed between the adjacent tongue and groove boards.

The tongue and groove board described above, which comprises a first and second major surface and a first and second longitudinal edge, also includes a first and second lateral end. In another alternative form of this invention, at least one of the first and second lateral ends has at least one substantially vertically-extending opening formed therein. Each such opening extends through the tongue and groove board from the longitudinally-extending upper surface to the longitudinally-extending lower surface for providing at least one drain path for water to drain by gravity from the first major surface downwardly through each the vertically-extending opening. Again, this prevents an accumulation of water on the tongue and groove board.

DETAILED DESCRIPTION OF THE PREFERRED EMBODIMENT

Figure 1:
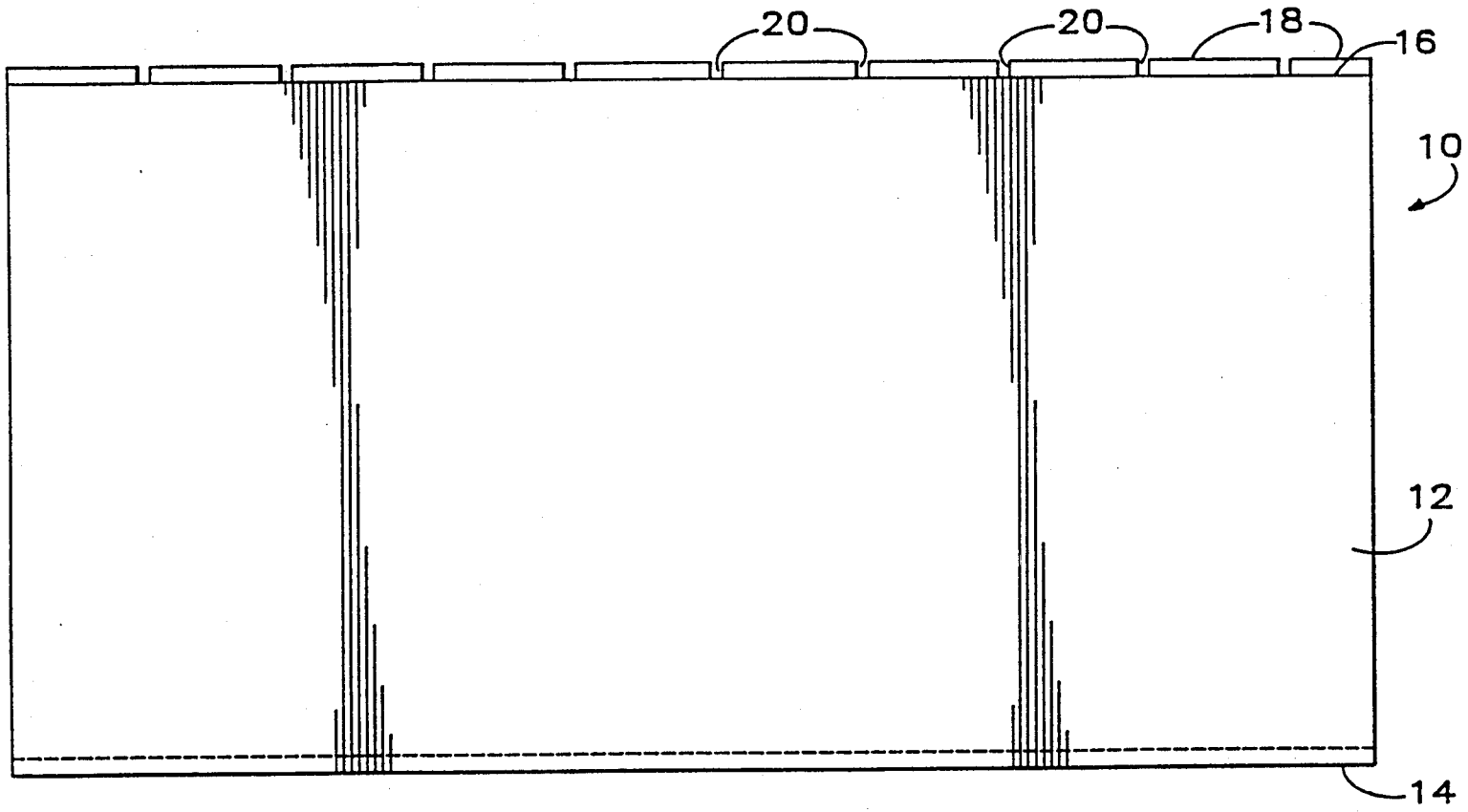
FIG. 1 is a plan view of a tongue and groove board showing one embodiment of the present invention.
Figure 3:
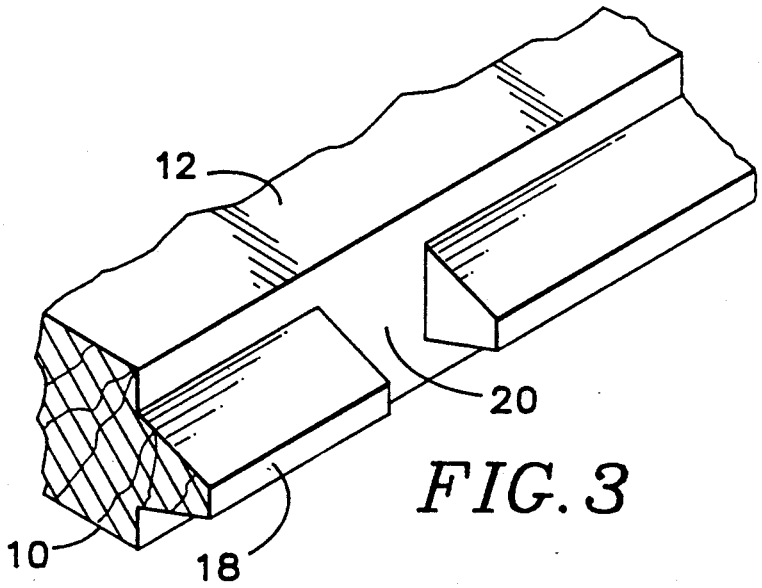
FIG. 3 is a perspective view of the tongued longitudinal edge of a tongue and groove board showing details of the notched tongue according to the present invention.

Referring now to the drawings, FIG. 1 shows a plan view of a 4' by 8' tongue and groove (T&G) board having an upper board surface 12, a grooved longitudinal edge 14, and a tongued longitudinal edge 16. A tongue 18 is formed along the length of edge 16. Vertical drain notches 20 are formed in tongue 18, and are spaced at 10" intervals along its length. Although 10" spacing is employed in this embodiment, other spacing intervals can be used depending on the equipment employed to produce the subject tongue and groove product, and the specific configuration of the spacing which a given manufacturer may seek to employ. Drain notch 20 in tongue 18 is shown in greater detail in FIG. 3.

Figure 2:
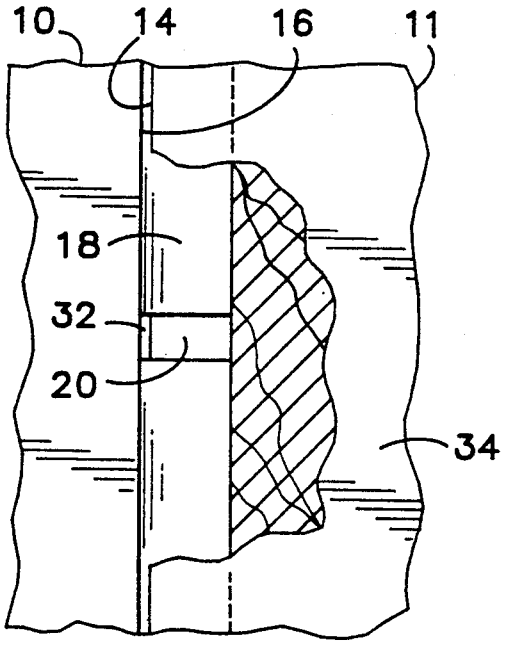
FIG. 2 is a sectional, plan view of a sub-floor assembly formed from tongue and groove boards according to the present invention.
Figure 4:
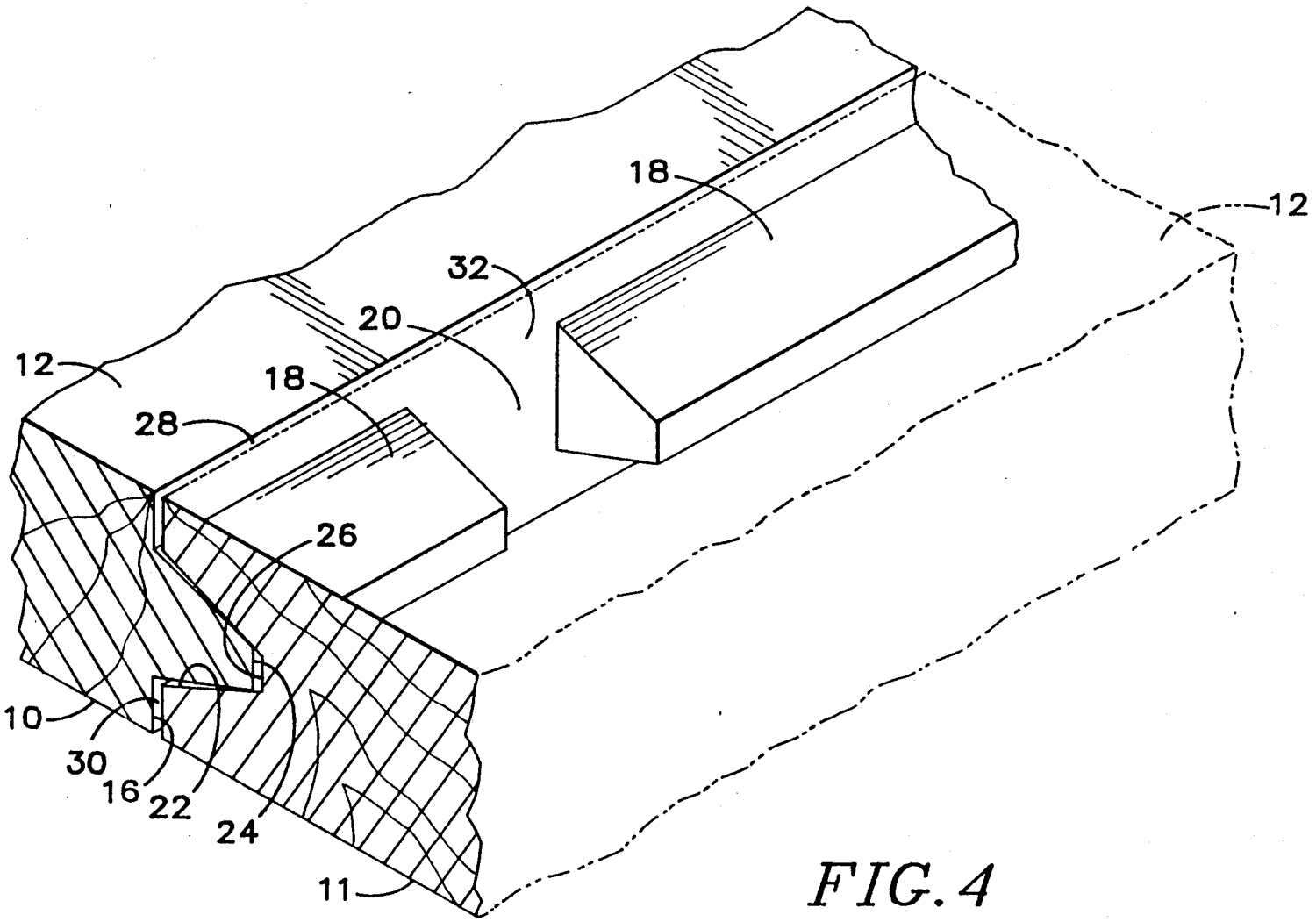
FIG. 4 is a perspective view of two interconnected tongue and groove boards according to the present invention showing the drain path for draining water from the upper surface of the sub-floor assembly.
Figure 5:
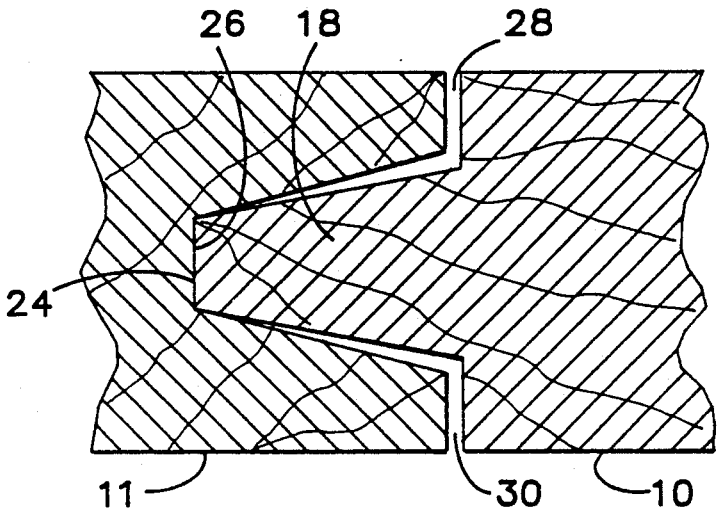
FIG. 5 is a side view of the tongued edge of a board interconnected with the grooved edge of an adjacent board, showing a first embodiment of complimentary tongue and groove dimensions.
Figure 6:
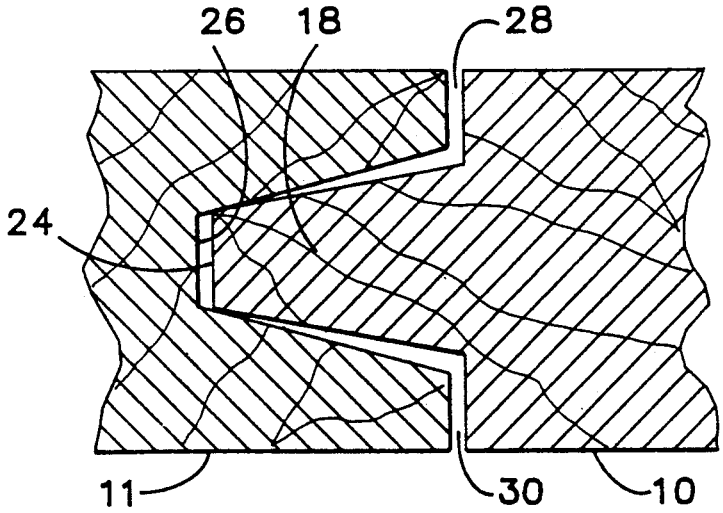
FIG. 6 is a side view of the tongue edge of a board interconnected with the grooved edge of an adjacent board, showing a second embodiment of complimentary tongue and groove dimensions.

Turning now to FIG. 4, adjacent T&G boards 10 are interconnected by tongue 18 being inserted into groove 22 of adjacent board 11. As best seen in FIG. 5, tongue face 24 rests against groove base 26 when tongue 18 is fully inserted. Tongue 18 protrudes a distance from board edge 16 which is greater than the depth of groove 22. FIG. 6 shows an alternative tongue design wherein tongue face 24 has a vertical dimension greater than the vertical dimension of groove base 26, so that when tongue 18 is inserted into groove 22, tongue face 24 engages groove 22 at a position away from groove base 26. In the case of each tongue embodiment, when board 10 and adjacent board 11 are interconnected, an upper space 28 and a lower space 30 separate tongued edge 16 from grooved edge 14 of adjacent board 11. A drain path 32 is thereby formed which includes upper space 28, drain notch 20, and lower space 30. Water (not shown) on upper surface 12 is drained by flowing into upper space 28, downwardly through drain notch 20, and through space 30. As shown in FIG. 2, a sectional, plan view of a completed sub-floor assembly 34 includes multiple drain paths 32 spaced along edges 14 and 16 of interconnected boards 10.

Figure 7:
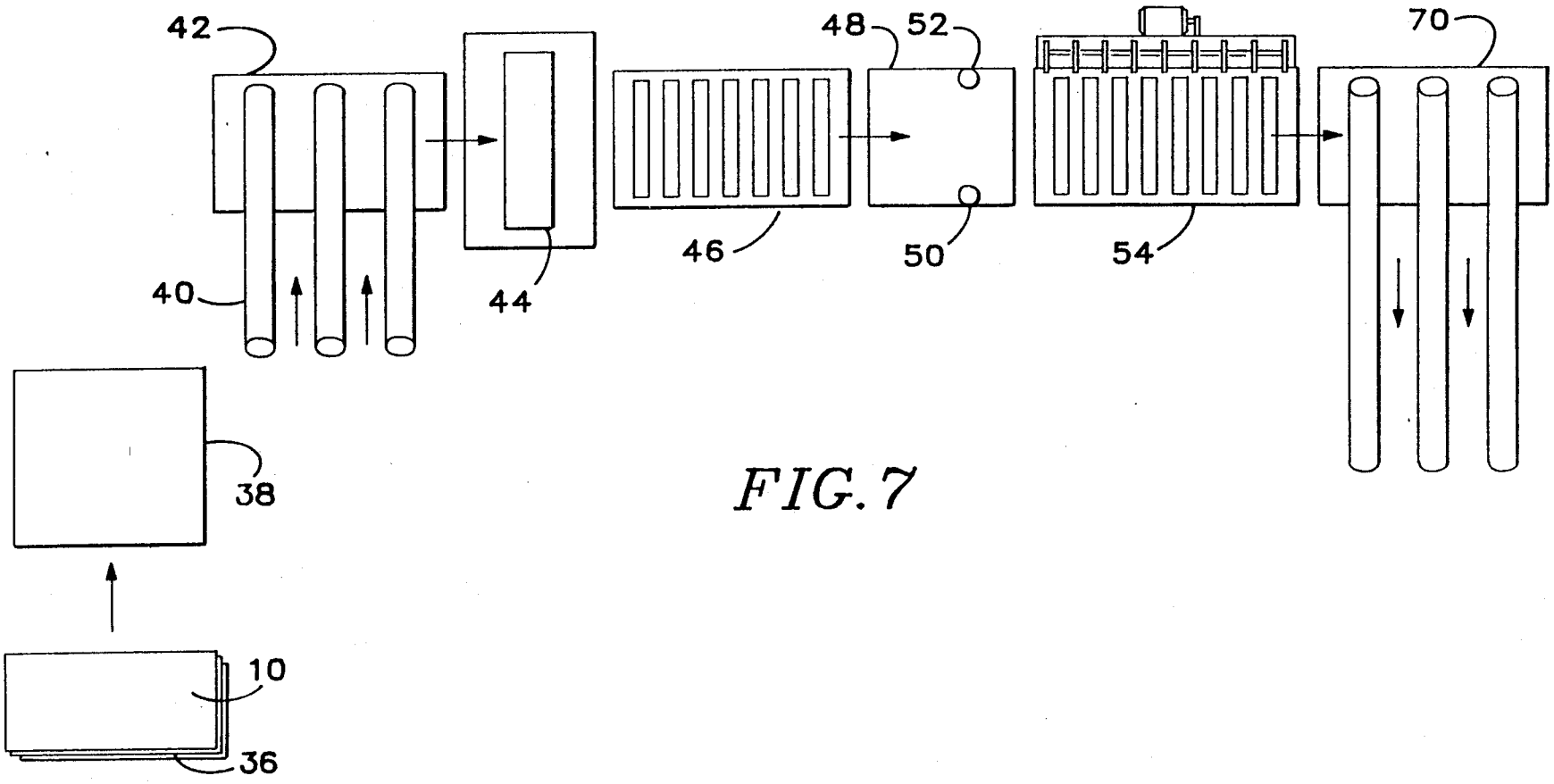
FIG. 7 is a schematic view of a system for making tongue and groove boards according to the present invention.

The preferred process for manufacture of T&G boards 10 is best demonstrated by referring to FIG. 7. A bundle not shown of boards 10 is transported to a bundle turner 38. Bundle 36 is then turned 180 degrees by bundle turner 38 and is then deposited onto inclined rollers 40 by a fork lift. Bundle 36 rolls down inclined rollers 40 and is deposited on a hydraulically-lifted infeed stacker 42. Infeed stacker 42 is then activitated and lifts bundle 36 to a pre-determined elevation for infeeding a first board 10 from the top of bundle 36 into sander 44. Board 10 is pushed from the top of bundle 36 into sander 44 by means of a pneumatic push cylinder (not shown).

Board 10 is supported in sander 44 on electrically driven rollers (not shown) which convey board 10 through sander 44 where board 10 is sanded to a predetermined uniform thickness. After sanding, sander 44 discharges board 10 onto driven rollers 46 into tongue and groove cutting unit 48.

Tongue and groove cutting unit 48 includes a groove cutting head 50 and a tongue cutting head 52. Tongue and groove cutting unit 48 guides board 10 into simultaneous engagement with groove cutting head 50 and tongue cutting head 52, thereby forming tongue 18 on longitudinal edge 16, and groove 22 in longitudinal edge 14.

Figure 8:
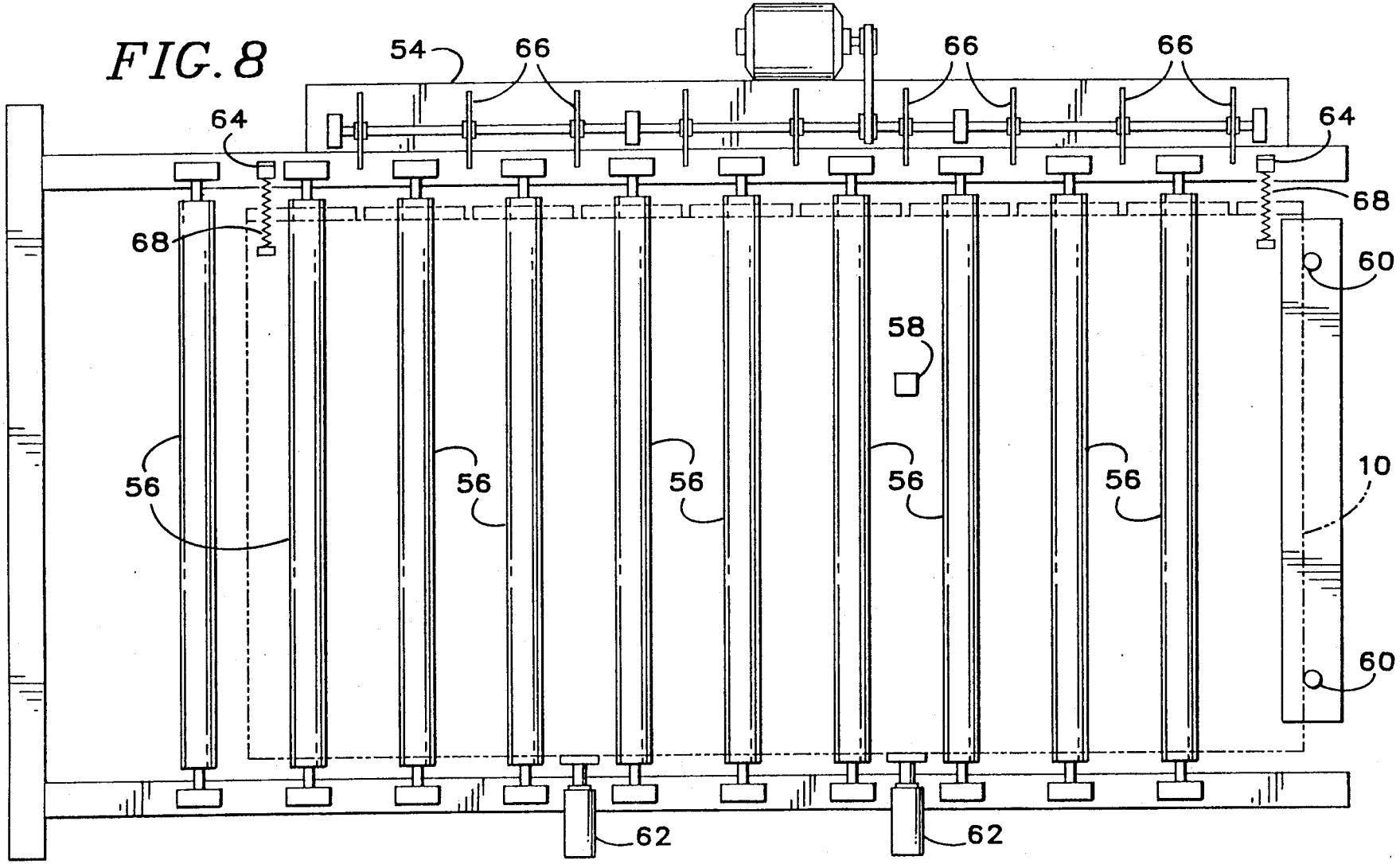
FIG. 8 is a schematic view of a notching apparatus for notching the tongue of tongue and groove boards according to the present invention.

Board 10 is then discharged from tongue and groove cutting unit 48 into notching unit 54 which can be seen in greater detail in FIG. 8. As board 10 enters notching unit 54, it is supported on driven rollers 56 which move it into position for notching. As board 10 proceeds along driven rollers 56, limit switch 58 is activated which signals pneumatic pin stops 60 to extend vertically into the path of board 10. Board 10 comes to rest against pin stops 60, where it is positioned for notching.

With board 10 in position for notching, pneumatic crowder rams 62 are actuated and push board 10 laterally into aligning jig 64 which precisely aligns board 10 for notching. Crowder rams 62 then push board 10 laterally into engagement with notch cutting blades 66.

Notch cutting blades 66 are a series of 8" circular, vertically mounted rotating blades which are positioned perpendicular to tongued edge 16. As board 10. is pushed into engagement with notch cutting blades 66, vertical drain notches are simultaneously cut through tongue 18 to a predetermined depth. Crowder rams 62 are then retracted, allowing board return springs 68 to pull aligning jig 64, and board 10, laterally away from cutting blades 66. Pin stops 60 are then actuated to retract, and driven rollers 56 discharge board 10 from notching unit 54. Returning now to FIG. 7, board 10 is discharged from notching unit 54 onto discharge stacker 70, where boards 10 are stacked into bundles (not shown) for marking and shipment.

Figure 9:
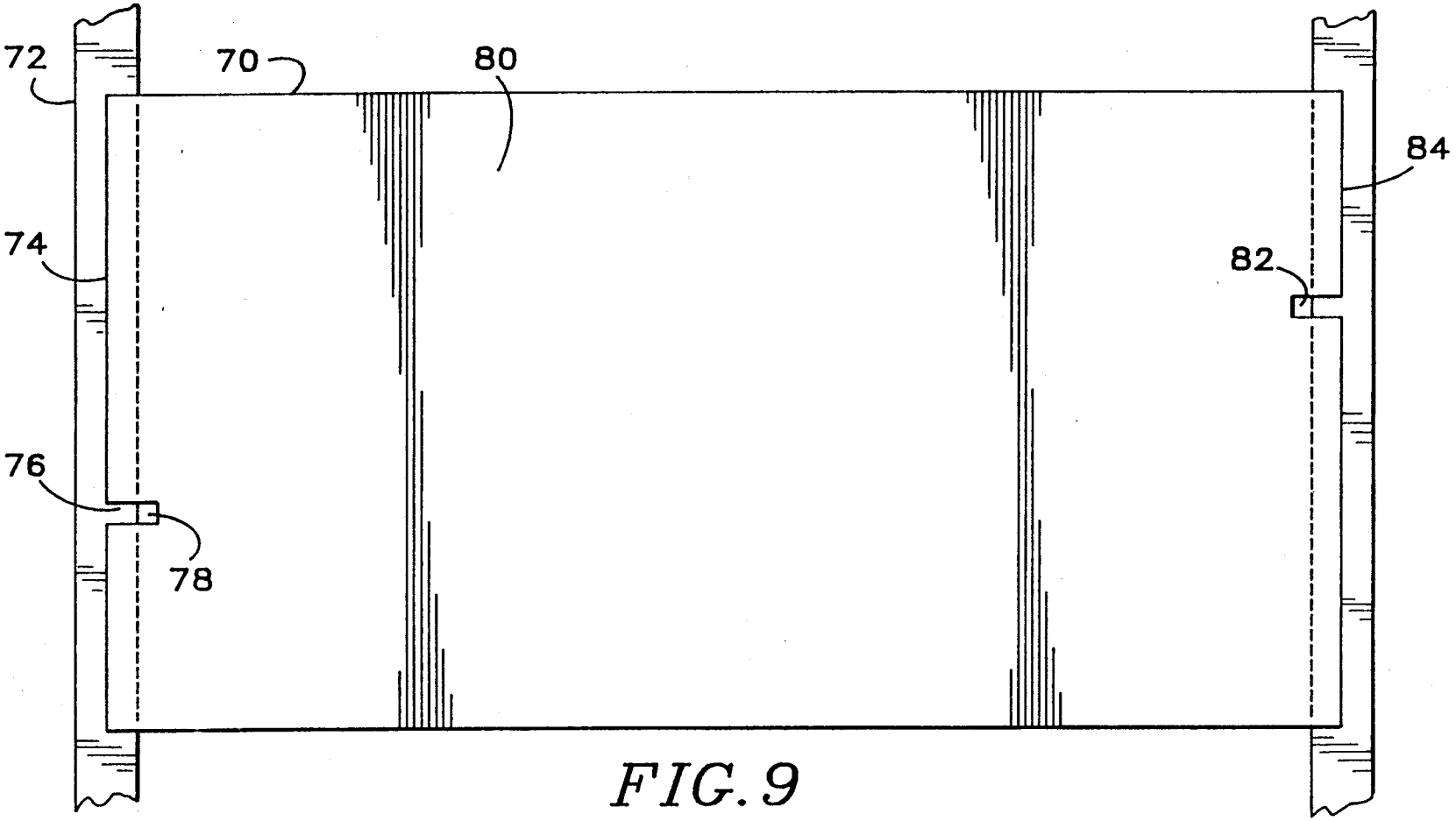
FIG. 9 is a plan view of a tongue and groove board have a lateral end which includes a vertically-extending notch for providing a drain path for draining water from the upper surface of the sub-floor assembly.

Referring now to FIG. 9, a plan view of an alternative embodiment is shown in which a tongue and groove board 70 is positioned on an underlying joist member 72. The board 70 differs form board 10 in that the lateral end 74 includes a substantially vetically-extending notch 76. Notch 76 is located on the joist member 72 so that it will extend beyond the joist member and form a drain path 78 for draining water from the upper surface 80 of the board 70. If desired, a second notch 82 (in phantom) can also be introduced into the other lateral end 84 of the board 70.

I claim:

1. A tongue and groove board, comprising:

first and second major surfaces;

first and second longitudinal edges;

said first longitudinal edge including means defining a longitudinally-extending groove extending inwardly of said longitudinal edge between said first and second major surfaces;

a tongue protruding from said second longitudinal edge, said tongue having an outer portion including longitudinally-extending upper and lower surfaces;

said outer portion of said tongue for being received within and interconnectingly engaging a complimentary longitudinal groove formed in a first longitudinal edge of an adjacent tongue and groove board for interconnecting said adjacent tongue and groove boards;

said protruding tongue having at least one substantially vertically-extending opening extending through said protruding tongue from said longitudinally-extending upper surface to said longitudinally-extending lower surface for providing at least one drain path for water to drain by gravity in a generally downwardly direction from said first major surfaces of said interconnected adjacent tongue and groove boards to a space below, thereby preventing an accumulation of water on said first major surfaces of said interconnected adjacent tongue and groove boards.

2. The tongue and groove board of claim 1, wherein said opening in said protruding tongue comprises a substantial vertically-extending notch.

3. The tongue and groove board of claim 1 which is formed from a material comprising any one of wood and a composite wood product.

4. The tongue and groove board of claim 3, wherein said composite wood product comprises any one of plywood, particleboard, waferboard and strand board.

5. A self-draining floor assembly comprising a plurality of interconnected tongue and groove boards, each said tongue and groove board comprising:

first and second major surfaces;

first and second longitudinal edges;

said first longitudinally edge including means defining a longitudinally-extending groove extending inwardly of said longitudinal edge between said first and second major surfaces;

a tongue protruding from said second longitudinal edge, said protruding tongue having an outer portion including upper and lower longitudinally-extending surfaces;

said outer portion of said tongue being received within and interconnectingly engaged with a longitudinally-extending groove formed in the first longitudinal edge of an adjacent tongue and groove board for interconnecting said adjacent tongue and groove boards for forming a floor assembly;

said protruding tongue having at least one substantially vertically-extending opening extending through said protruding tongue from said longitudinally-extending upper surface to said longitudinally-extending lower surface for providing at least one drain path for water to drain by gravity from said first major surfaces of said adjacent tongue and groove boards in a generally downwardly direction to a space below, thereby preventing an accumulation of water on said first major surfaces of said interconnected adjacent tongue and groove boards.

6. The tongue and groove board of claim 5, wherein each said opening in said protruding tongue comprises a substantial vertically-extending notch.

7. The tongue and groove board of claim 5 which is formed from a material comprising any one of wood and a composite wood product.

8. The tongue and groove board of claim 7, wherein said composite wood product comprises any one of plywood, particleboard, waferboard and strand board.

9. A method for making a tongue and groove board comprising the steps of:

forming a tongue and groove board having first and second major surfaces, a first longitudinal edge including means defining a longitudinally-extending groove extending inwardly of said longitudinal edge between said first and second major surfaces, and a second longitudinal edge including means defining a longitudinally-extending protruding tongue for interconnectingly engaging a grooved edge of an adjacent tongue and groove board, said protruding tongue having an outer portion including upper and lower longitudinally-extending surfaces; and said protruding tongue having therein at least one substantially vertically-extending opening, each said opening extending through said protruding tongue from said longitudinally-extending upper surface to said longitudinally-extending lower surface for providing at least one drain path for water to drain by gravity from said first major surface downwardly through each said vertically-extending opening, thereby preventing an accumulation of water on said tongue and groove board when interconnectingly engaged with an adjacent tongue and groove board.

10. The method of claim 9, which further includes the step of introducing said opening into said protruding tongue.

11. The method of claim 9, which further includes the step of forming said tongue and groove board from a material comprising any one of wood and a composite wood product.

12. The method of claim 11, wherein said composite wood product comprises any one of plywood, particleboard, waferboard and strand board.

13. A method of forming a self-draining floor assembly of tongue and groove boards comprising the steps of:

forming a plurality of tongue and groove boards, each tongue and groove board having first and second major surfaces, a first longitudinal edge including means defining a longitudinally-extending groove, and a second longitudinal edge including means defining a protruding longitudinal tongue for interconnectingly engaging a grooved edge of an adjacent tongue and groove board, said protruding tongue having an outer portion including upper and lower longitudinally-extending surfaces;

each said protruding tongue having therein at least one substantially vertically-extending opening, each said opening extending through said protruding tongue from said longitudinally-extending upper surface to said longitudinally-extending lower surface for providing at least one drain path for water to drain by gravity from said first major surface downwardly through each said vertically-extending opening, thereby preventing an accumulation of water on said tongue and groove boards; and interlockably engaging said tongue and groove boards by inserting said outer portion of said protruding tongue of a first tongue and groove board into said longitudinal groove of a second tongue and groove board, thereby forming said self-draining floor assembly.

14. The method of claim 13, which further includes the step of introducing said opening into said protruding tongue.

15. The method of claim 13, which further includes the step of forming said tongue and groove board from a material comprising any one of wood and a composite wood product.

16. The method of claim 15, wherein said composite wood product comprises any one of plywood, particleboard, waferboard and strand board.

17. The tongue and groove board of claim 1, wherein the outer portion of said protruding tongue has a configuration which is different than the configuration of said longitudinally-extending groove, thereby forming a drain path between said longitudinally-extending protruding tongue and said longitudinally-extending groove.

18. The tongue and groove board of claim 5, wherein the outer portion of said protruding tongue has a configuration is different than the configuration of said longitudinally-extending groove, thereby forming a drain path between said protruding tongue and said longitudinally-extending groove.

19. The method of claim 9, wherein said outer portion of said protruding tongue has a configuration which is different than the configuration of said longitudinally-extending groove, thereby forming a drain path between said protruding tongue and said longitudinally-extending groove.

20. The method of claim 13, wherein said outer portion of said protruding tongue has a configuration which is different than the configuration of said longitudinally-extending groove, thereby forming a drain path between said protruding tongue and said longitudinally-extending groove.

21. The tongue and groove board of claim 1, wherein a lateral dimension of the outer portion of said protruding tongue is greater than the depth of said longitudinally-extending groove, thereby forming a drain path between said protruding tongue and said longitudinally-extending groove.

22. The tongue and groove board of claim 5, wherein the lateral dimension of said protruding tongue is greater than the depth of the recess formed by said longitudinally-extending groove, thereby forming a drain path between said protruding tongue and said longitudinally-extending groove.

23. The tongue and groove board of claim 9, wherein the lateral dimension of said protruding tongue is greater than the depth of the recess formed by said longitudinally-extending groove, thereby forming a drain path between said protruding tongue and said longitudinally-extending groove.

24. The tongue and groove board of claim 13, wherein the lateral dimension of said longitudinally-extending protruding tongue is greater than the depth of the recess formed by said longitudinally-extending groove, thereby forming a drain path between said protruding tongue and said longitudinally-extending groove.

25. The tongue and groove board of claim 1, wherein the longitudinally-extending groove is tapered in its transverse dimension from its outer edge to its inner edge, and wherein a transverse dimension of the outer portion of the protruding tongue is greater than the transverse dimension of the longitudinally-extending groove at its inner edge, so that when the outer portion of the tongue is inserted into the complementary groove of an adjacent tongue and groove board, the outer tongue edge of the protruding tongue engages said tapered groove at a position for spacing the outer portion of said tongue away from the recess inner edge for forming a drain path between the adjacent tongue and groove boards.

26. The tongue and groove board of claim 4, wherein said strand board comprises oriented strand board.

27. The tongue and groove board of claim 8, wherein said strand board comprises oriented strand board.

28. The tongue and groove board of claim 12, wherein said strand board comprises oriented strand board.

29. The tongue and groove board of claim 16, wherein said strand board comprises oriented strand board.

* * * * *